US006523705B2

(12) United States Patent
Henderson et al.

(10) Patent No.: US 6,523,705 B2
(45) Date of Patent: Feb. 25, 2003

(54) BOTTLE RACK

(75) Inventors: William Henderson, New Rochelle, NY (US); Peter J. Teniuch, Tarrytown, NY (US)

(73) Assignee: Sidney Frank Importing Co., Inc, New Rochelle, NY (US)

( * ) Notice: Subject to any disclaimer, the term of this patent is extended or adjusted under 35 U.S.C. 154(b) by 0 days.

(21) Appl. No.: 09/910,504

(22) Filed: Jul. 19, 2001

(65) Prior Publication Data

US 2003/0015487 A1 Jan. 23, 2003

(51) Int. Cl.[7] ..... A47F 7/00

(52) U.S. Cl. ..... 211/74; 211/181.1; 248/311.2; D7/704

(58) Field of Search ..... 211/74, 181.1; 248/311.2, 315; D7/701, 704; 294/146, 159, 137

(56) References Cited

U.S. PATENT DOCUMENTS

| | | | | |
|---|---|---|---|---|
| 2,259,667 A | * | 10/1941 | Smith | |
| 2,703,689 A | * | 3/1955 | Williams | |
| D261,891 S | * | 11/1981 | Thompson et al. | |
| 4,944,415 A | * | 7/1990 | Orbach | 211/181.1 X |
| 5,558,236 A | * | 9/1996 | Williams et al. | 211/74 |
| D386,363 S | * | 11/1997 | Dardashti | D7/704 |

* cited by examiner

*Primary Examiner*—Robert W. Gibson, Jr.
(74) *Attorney, Agent, or Firm*—Schweitzer Cornman Gross & Bondell LLP

(57) ABSTRACT

A new and improved display rack for holding a pair of bottles comprises a pair of "S-shaped" or "open figure-8" shaped wire support members welded to two pairs of horizontal bottle-support bars, the lowermost of which include four foot portions. A plastic base member mounts the foot portions of the lower bars.

3 Claims, 3 Drawing Sheets

FIG. 3
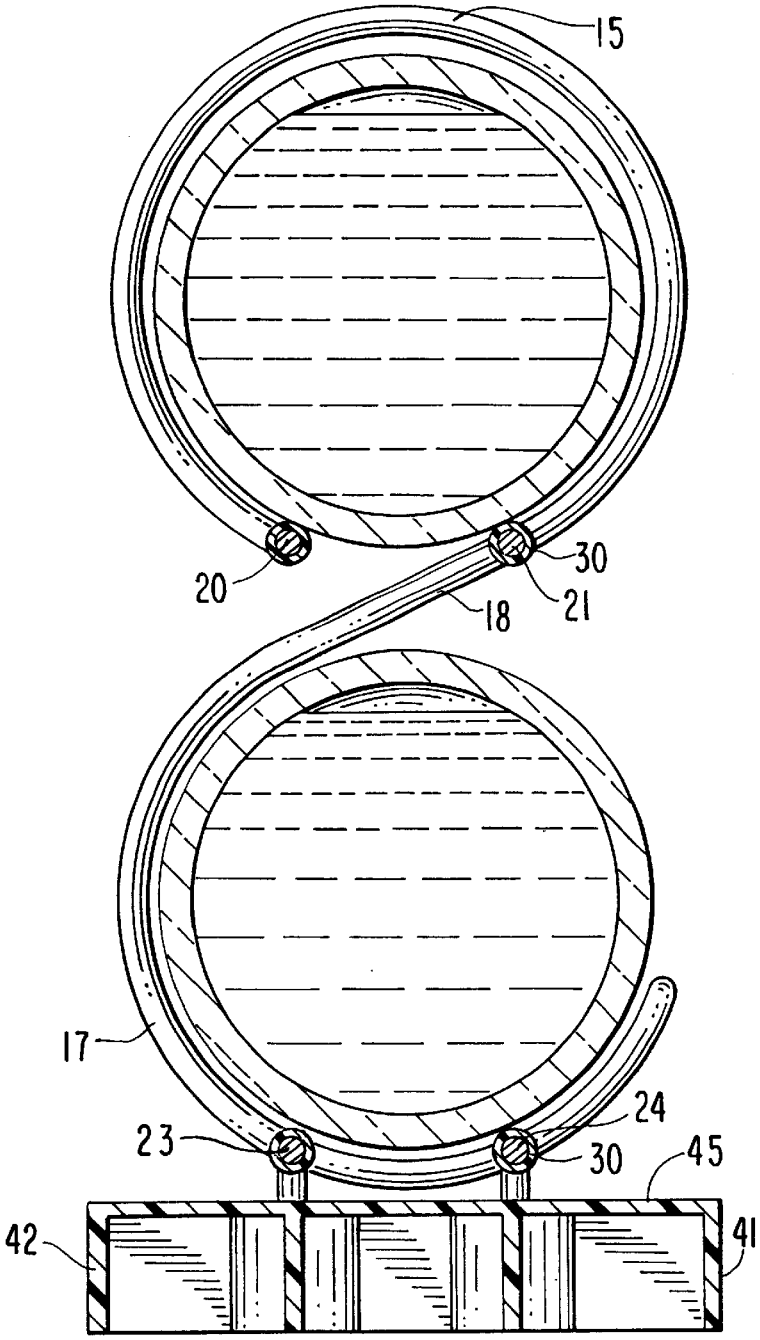
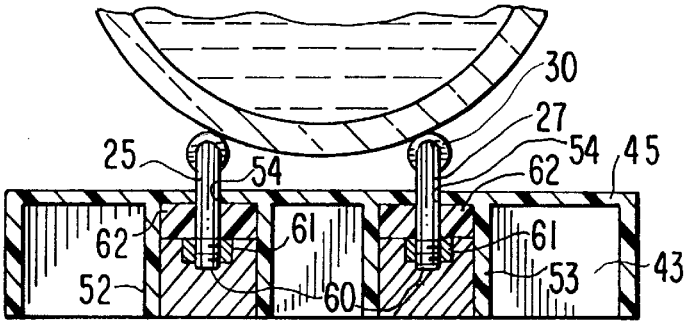
FIG. 4

BOTTLE RACK

BACKGROUND

Display mechanisms, including simple racks for plates, bottles, and other artifacts are well known to the art. Simple frames and supports fabricated from wood, metal, plastics, and combinations thereof have been used in domestic and commercial environments for displaying articles of all sizes and shapes.

BRIEF SUMMARY OF THE PRESENT INVENTION

The display rack of the present invention provides a new and improved apparatus for holding a pair of bottles. The new rack is attractive and simple to manufacture, comprising a pair of "S-shaped" or "open figure-8" shaped wire support members welded to two pairs of horizontal bottle-support bars, the lowermost of which include four foot portions. A plastic base member mounts the foot portions of the lower bars. The entire unit is efficient and streamlined, providing an aesthetic unit for displaying a pair of elongated cylindrical objects, for example a pair of bottles.

For a more complete understanding of the present invention and a better appreciation of its attendant advantages, reference should be made to the following detailed description, taken in conjunction with the accompanying drawings.

DESCRIPTION OF THE DRAWINGS

FIG. 3 is a cross-sectional view of the rack taken along line 3—3 of FIG. 2;

FIG. 4 is a fragmentary cross-sectional view taken along line 4—4 of FIG. 2 showing details of mounting of the lower support bars to the base.

DETAILED DESCRIPTION OF THE INVENTION

Figure 1:
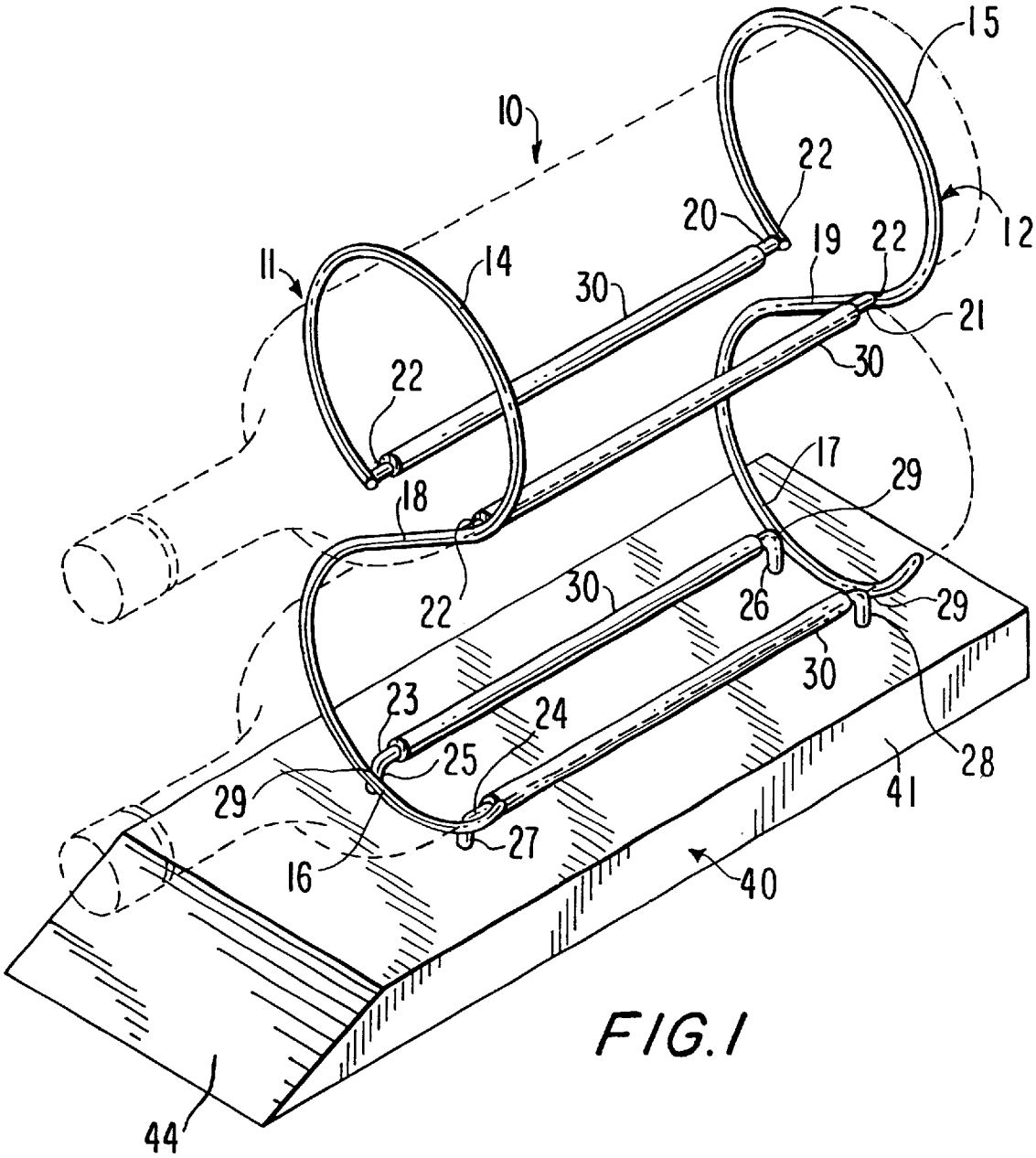
FIG. 1 is a perspective view of the new bottle rack of the present invention.
Figure 2:
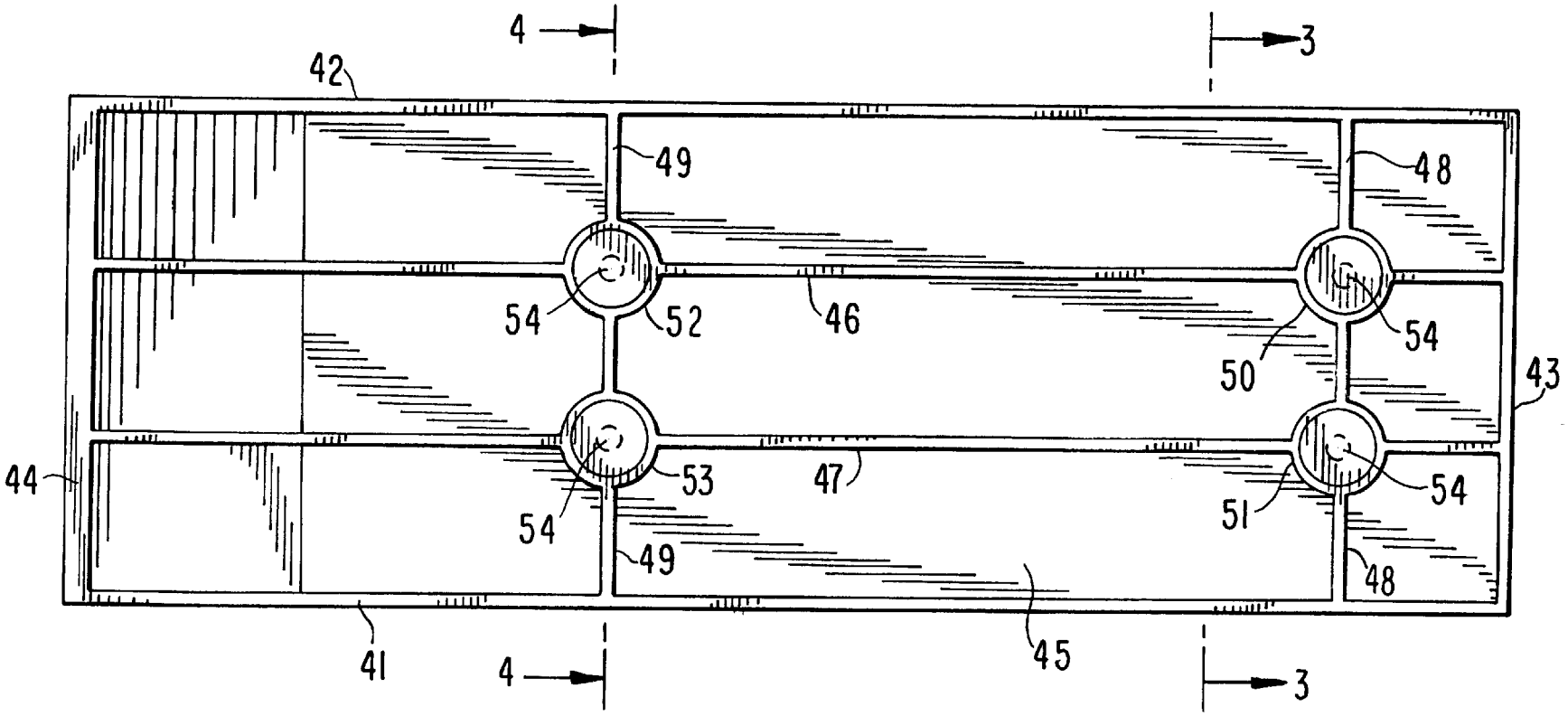
FIG. 2 is a bottom view of the base of the rack.

Referring to FIG. 1, the new rack apparatus 10 of the invention is adapted to hold and display a pair of bottles, for example a pair of one liter beverage bottles (shown in phantom).

The rack 10 comprises an opposed pair of vertical serpentine frame members 11, 12 generally in the shape of an "S" or an "open FIG. 8". The members 11, 12 each have upper open circular portions 14, 15 connected to lower open circular portions 16, 17 by median portions 18, 19.

Upper horizontal support bars 20, 21 extend between the lowermost points of circular portions 14, 15 and are secured thereto by welds 22 or alternative fasteners.

A pair of lower support bars 23, 24 having integral depending foot portions 25, 26, 27, 28 are connected to the circular portions 16, 17 by welds 29 or alternative fasteners.

The horizontal bars 20, 21 and 23, 24 as well as the frame members 11, 12 are fabricated from steel rod of approximately 0.30 inches diameter, which is bent to shape. Protective sleeves 30 of transparent elastomeric material, e.g. neoprene or polyethylene, are placed over each of the bars 20–24 to provide cushioning and sliding support of the articles to be displayed. The sleeves protect the bottles from marring and facilitate sliding insertion and removal of bottles.

The sub-assembly or weldment of the four horizontal bars 20–24 with the vertical frame members 11, 12 is electrostatically powder coated to provide a durable finish before the sub-assembly is mounted to a base member 40 formed from injection molded plastic, e.g. polyester, polystyrene, acrylic, or the like.

As shown in FIGS. 1–4, the base 40 has vertical side walls 41, 42, a vertical rear wall 43, and a sloping front wall 44, all integrally connected to and supporting horizontal planar top wall 45. The front wall provides a large, visible surface upon which display material may be supported or upon which graphics may be incorporated by molding.

The base 40 includes integral longitudinal reinforcing ribs 46, 47 and transverse reinforcing ribs 48, 49. At the intersections of the reinforcing ribs, four hollow circular bosses 50–53 are formed. The bosses surround mounting holes 54 formed in the top wall 45. The mounting holes 54 snuggly receive the foot portions 25–28 of the bars 23, 24 as shown in FIGS. 1 and 4.

The portions 25–28 have threaded end portions 60 which may be securely fastened to the base 40 by lock nuts 61 acting against cylindrical washers 62, disposed within the bosses 50–53 as shown in FIG. 4. If desired, friction pads (not shown) may be adhered to the bottommost portions of the ribs 48, 49 to prevent slipping of the base on smooth surfaces.

As will be appreciated, the bottle rack or organizer elements shown and described herein may be easily manufactured and quickly assembled to provide a rigid and attractive apparatus for displaying cylindrical merchandise or articles such as beverage bottles.

Although the foregoing description has been given by way of preferred embodiment, it will be understood by those skilled in the art that other forms of the invention falling within the ambit of the following claims are contemplated. Accordingly, reference should be made to the following claims in determining the full scope of the invention.

We claim:

1. A display rack for supporting a pair of generally cylindrical objects, said rack comprising:

(a) a base member having an upper planar surface, a lower planar surface, and circumscribing side walls;

(b) serpentine first and second vertical end supports having upper generally circular portions and lower generally circular portions interconnected by a median portion definitive of an open figure eight; the lower circular portion having a central arc;

(c) a pair of horizontal lower longitudinal support bars having downwardly projecting foot portions at each end;

(d) the base member defining a pair of spaced first openings adapted to receive the foot portions of said lower horizontal support bars and to secure said horizontal supports to said base member;

(e) said horizontal support bars being welded to the central arc;

a pair of upper horizontal longitudinal bottle support bars extending in parallel between the upper circular portions and being secured thereto.

2. The display rack of claim 1 in which:

(a) the vertical end supports and horizontal support bars are fabricated from wire rod; and (b) the base member is injection molded thermoplastic.

3. The display rack of claim 1 in which (a) elastomeric sleeve members are mounted on said lower horizontal support bars and on said upper longitudinal support bars.

* * * * *